US005337500A

United States Patent [19]

Enokizono

[11] Patent Number: 5,337,500

[45] Date of Patent: Aug. 16, 1994

[54] UTENSIL DRYING APPARATUS

[75] Inventor: Tomoki Enokizono, Seto, Japan

[73] Assignee: Kabushiki Kaisha Toshiba, Kawasaki, Japan

[21] Appl. No.: 12,959

[22] Filed: Feb. 2, 1993

[30] Foreign Application Priority Data

Feb. 5, 1992 [JP] Japan ..... 4-019863

[51] Int. Cl.[5] ..... F26B 21/06

[52] U.S. Cl. ..... 34/77; 34/233; 34/225

[58] Field of Search ..... 34/218, 231, 73, 76, 34/72, 133 A, 90, 77, 78, 233, 219–225

[56] References Cited

U.S. PATENT DOCUMENTS

| | | | |
|---|---|---|---|
| 2,918,068 | 12/1959 | Karig | 34/90 |
| 3,026,628 | 3/1962 | Berger, Sr. et al. | 34/231 |
| 3,908,681 | 9/1975 | Schimke et al. | 34/231 |
| 4,179,821 | 12/1979 | Herbst et al. | 34/235 |
| 4,188,732 | 2/1980 | Quayle | 34/231 |
| 4,489,507 | 12/1984 | Kawai | 34/77 |

FOREIGN PATENT DOCUMENTS

| | | |
|---|---|---|
| 2-218326 | 8/1990 | Japan . |
| 641226 | 8/1950 | United Kingdom . |
| 750075 | 6/1956 | United Kingdom . |
| 2026147 | 1/1980 | United Kingdom . |
| 2107839 | 5/1983 | United Kingdom . |

*Primary Examiner*—Denise Gromada
*Attorney, Agent, or Firm*—Cushman, Darby & Cushman

[57] ABSTRACT

A dishwasher includes a washing chamber where a heater is located. The air within the chamber is circulated by a first fan through a circulation duct. An inlet and an outlet for the outside air is located on the front surface of the dishwasher. The inlet and the outlet are connected by the outside air duct. A heat exchanger is located between the outside air duct and the circulation duct. The outside air is circulated by a second fan from the inlet to the outlet to exchange the heat between the outside air and the inside air.

11 Claims, 2 Drawing Sheets

UTENSIL DRYING APPARATUS

BACKGROUND OF THE INVENTION

The present invention relates to a dryer which dries utensils stored in a chamber of the dryer and more particularly to a dryer which circulates the air within the chamber of the dryer. The dryer of this invention can be provided with an additional conventional structure for washing dishes, thereby a dishwasher comprising the dryer of this invention can be provided.

A prior dishwasher comprising a dryer is disclosed in Japan Patent Publication No. 02-218327. In the disclosed dishwasher, a drying chamber where dishes are stored in racks is provided within an outer case. The moist air in the dish holding portion of the chamber is circulated to a rotating heat transfer unit located at the rear side of the chamber by a fan within the chamber. The air is also heated by a heater attached to the bottom of the chamber. Such as above described, the heated air is returned to the dish holding portion. Outside air is drawn into the outer case through inlets located on the rear wall of the outer casing. Then the outside air contacts the rotating heat transfer unit so that the heat is transferred between the air within the chamber and the outside air. After that, the outside air is exhausted from the outer casing through outlets located on the rear wall of the outer casing.

In this type of dryer or dishwasher, however, the outside air is drawn through the rear wall of the outer casing of the dishwasher, and then the air is exhausted to the rear of the dishwasher through the outlets located on the rear wall of the outer case. Therefore, when the dryer is included in a system kitchen, e.g., being installed in a row, the outside air with the heat absorbed from the inside air by the heat transfer unit, and exhausted to rearward, is held in a rear space between the rear wall of the dryer and a wall of the kitchen. Since the exhausted air is drawn into the inlets again, the air within the chamber is not cooled by the outside air efficiently. As a result, the dehumidifying capability of the dryer is reduced, and the capability of drying dishes is also reduced.

Further, in the prior dryer, although the dryer can be used independently, the space from which the outside air is drawn and exhausted to is still required to heat the rear area of the dryer. As a result, the dryer must be located with some distance between its rear wall and a wall in the kitchen. Consequently, there is another problem that more space is required to operate the dryer.

SUMMARY OF THE INVENTION

It is an object of the present invention to provide a dryer which can dry dishes efficiently with constant capability of dehumidifying thereof, even though the dryer is installed in a kitchen system.

It is another object of the present invention to provide a dryer in which the space where the dryer is located is minimized.

In order to achieve the above objects of the present invention, there is provided a dish dryer having a front surface, comprising:

a) a chamber, having a first inlet and a first outlet, for containing utensils;

b) first passage means, provided outside of the chamber, for connecting the first inlet and the first outlet;

c) heating means, mounted in the chamber, for heating air in the chamber to promote drying of the utensils;

d) first fan means for exhausting the heated air from the chamber through the first outlet and for returning the exhausted air to the first inlet through the first passage means;

e) a second inlet and a second outlet provided on the front surface;

f) second passage means, provided outside of the chamber, for connecting the second inlet and the second outlet;

g) second fan means for sucking outside air through the second inlet and for exhausting the outside air to the second outlet through the second passage means; and h) heat transferring means, provided between the first passage means and the second passage means, for transferring heat between the heated air in the chamber and the outside air in the second passage means.

The present invention is further directed to a method for drying utensils. The method comprises the step of heating air within the chamber, drawing the heated air from an upper portion of the chamber, passing the drawn heated air over a first side of a heat exchanger to provide cooled air, exhausting the cooled air into a lower portion of the chamber, drawing air from outside the utensil dryer through an inlet in the front surface, passing the drawn outside air over a second side of the heat exchanger to cool the heated air passed over the heat exchanger first side, and exhausting the outside air, after passing over the heat exchanger second side, through an outlet in the front surface of the dryer.

DESCRIPTION OF THE PREFERRED EMBODIMENT

Figure 1:
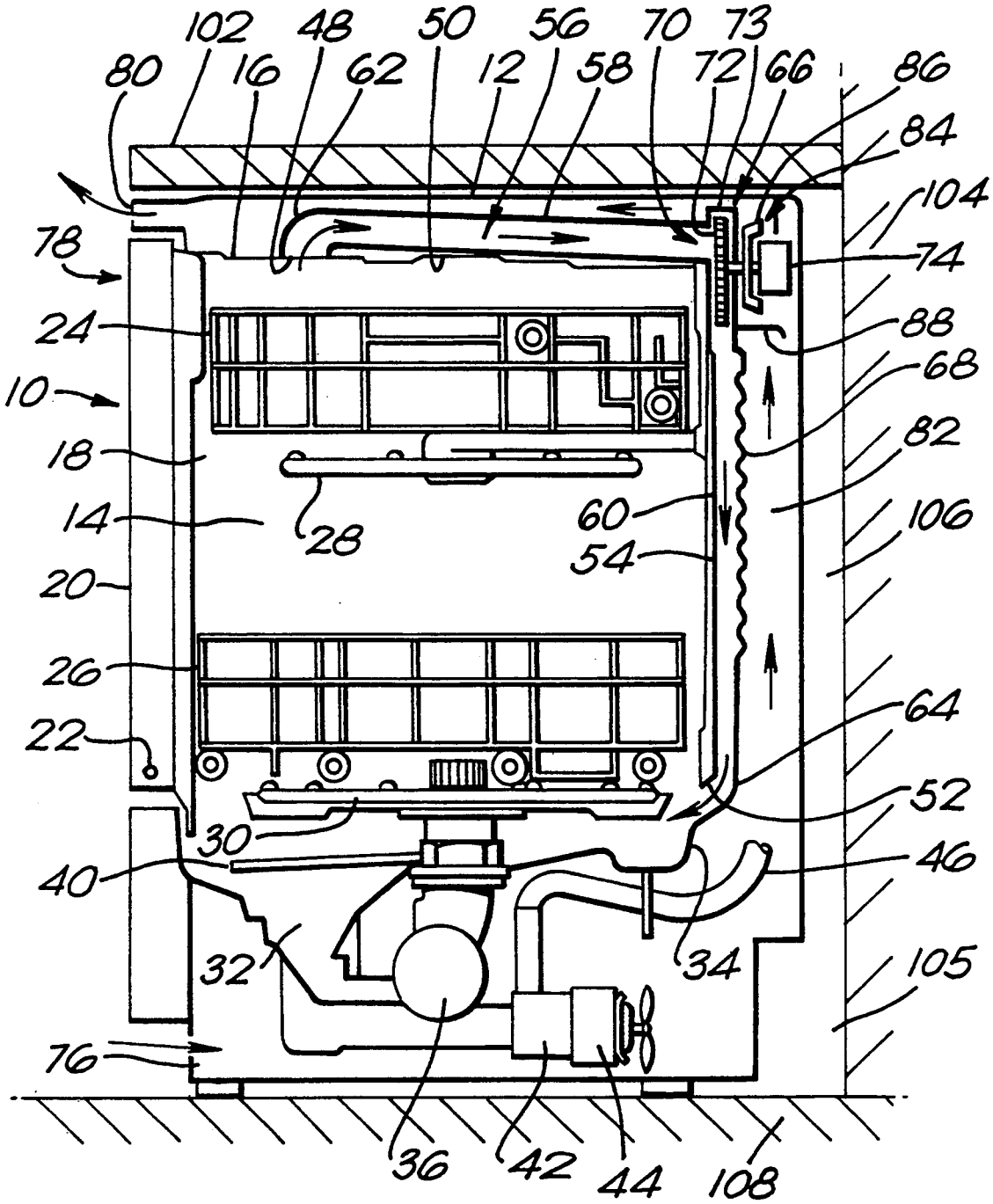
FIG. 1 is a view in vertical section of a dishwasher including an embodiment of the present invention.

An embodiment in which the present invention is adopted to a dishwasher will now be described with reference to FIG. 1 and FIG. 2. In FIG. 1, a dishwasher 10 includes an outer case 12 that surrounds a dishwashing chamber 14, which also serves as a drying chamber, which is defined by an inner case 16. An opening 18 of the chamber 14 is in the front of the chamber 14, a door 20 which opens and closes the opening 18 is pivotally mounted by means such as pins 22 on the outer case 12. Within the chamber 14 are located an upper rack 24 and a lower rack 26, which contain utensils such as dishes or the like (not shown), slidable into and out of the chamber 14 through the opening 18. An upper spray arm 28 and a lower spray arm 30 which spray the water to the dishes contained on the racks 24, 26 during a wash cycle and a rinse cycle are located under the upper rack 24 and the lower rack 26, respectively. A liquid container 32 is provided on a depressed portion of a bottom 34 of the chamber 14. A washing pump 35 having a motor, connected to the liquid container 32, which supplies the water in the liquid container 32 to the upper spray arm 28 and the lower spray arm 30, is located under the bottom 34. A heater 40 as heating means is attached to the bottom 34, and is provided to heat the water in the liquid container 32 during the wash cycle, and the rinse cycle, and to heat the air in the chamber 14 during a drying cycle. A drain pump 42, having a drain motor 44, connected to the liquid container 32, is located under the bottom 34. The drain pump 42 drains the water in the liquid container 32 into the outside of the dishwasher 10 through a drain pipe 46 connected to the drain pump 42. A first outlet 48 is located on an upper wall 50 of the inner case 16, and a first inlet 52 is located on a lower portion of a rear wall 54 of the inner case 16.

A circulation duct 56 as a first passage means comprises an upper duct 58 and a rear duct 60. The upper duct 58, in which one side 62 thereof is connected to the first outlet 48, is located above the upper wall 50 of the chamber 14, and the rear duct 60 in which one side 64 thereof is connected to the first inlet 52, is located rearward of the rear wall 54. The upper duct 58 is connected to the rear duct 60 near an upper rear corner portion 66 of the chamber 14. A heat exchanger 68 as heat transferring means is located in the rear duct 60 as a piece of a wall of the rear duct 60. A first fan assembly 70 as a first fan means comprises a first fan 72 within a first fan casing 73 and a fan motor 74 driving the first fan 72. The first fan 72 is located in the upper rear corner portion 66 of the circulation duct 56.

A second inlet 76 is located under the chamber 14, and in a lower portion of a front surface 78 of the dishwasher 10. A second outlet 80 is located above the chamber 14, and in an upper portion of the front surface 78 of the dishwasher 10. An outside air duct 82 as a second passage means is provided around the chamber 14 and between the inner case 16 and the outer case 12, and one side of the outside air duct 82 is connected to the second inlet 76 and the other side of the duct 82 is connected to the second outlet 80. Within the outside air duct 82, the washing pump 36, the drain pump 42 and the drain motor 44 are located adjacent to the second inlet 76. The heat exchanger 68 forms a piece of a wall of the outside air duct 82, also, so that the heat is exchanged between the inside air in rear duct 60 and the outside air in duct 82 by the heat exchanger 68. A second fan assembly 84 as a second fan means comprises a second fan 86 within a second fan casing 88. The second fan 86 is driven by the fan motor 74 which is an element of the first fan assembly 70. The second fan 86 and the fan motor 74 are located in the outside air duct 82, and between the heat exchanger 68 and the second outlet 80.

Figure 2:
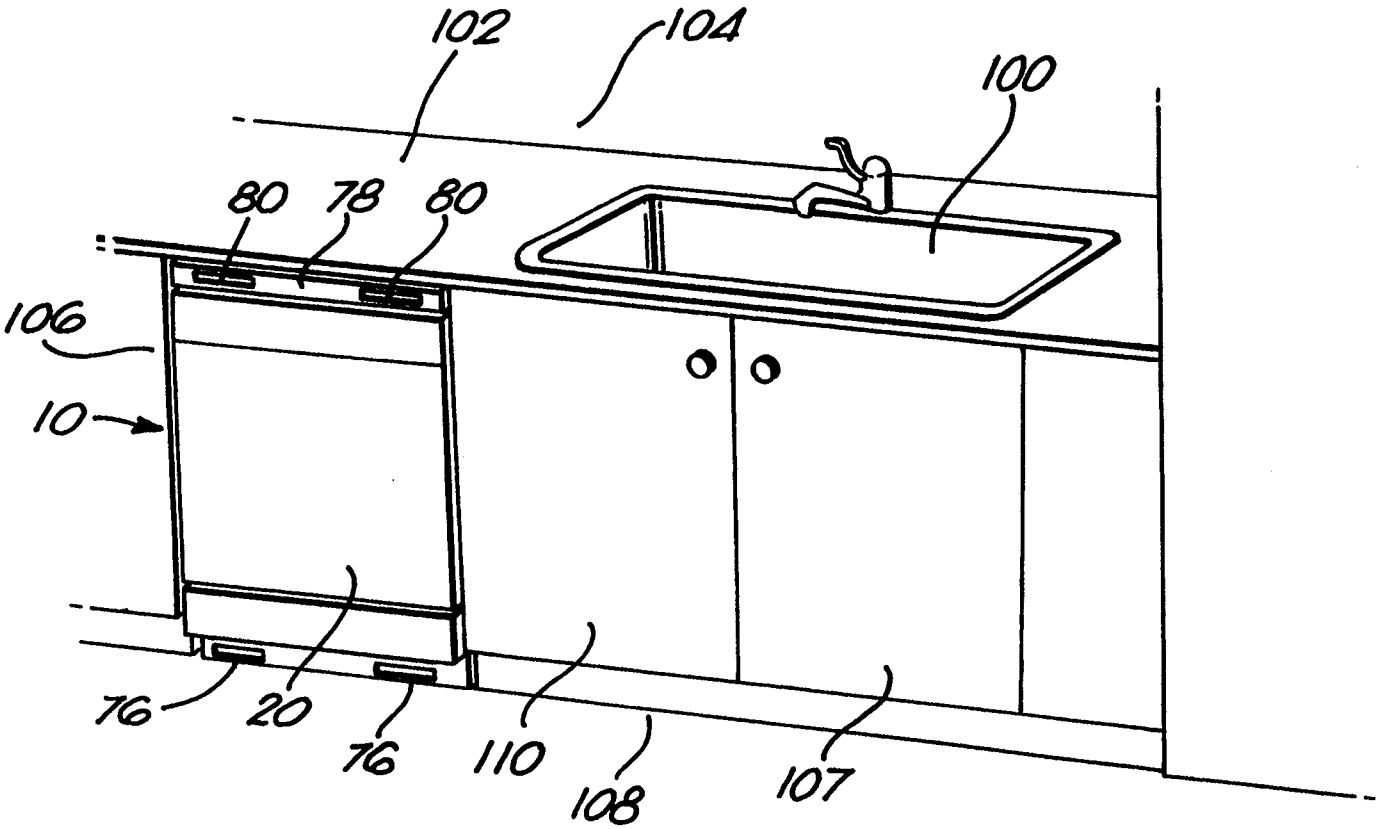
FIG. 2 is a perspective view of kitchen units including a dishwasher constructed in accordance with an embodiment the present invention.

With reference to FIG. 2, a sink 100, as a part of a series of kitchen units 106, is provided in a counter 102 fixed on a wall 104. The kitchen units can include units such as a storage cabinet or a sink base 107. The dishwasher 10 is installed into a space 105 defined by the sink 100, one of the kitchen units 106, the wall 104, the counter 102 and a floor 108. When the dishwasher 10 is installed into the space 105, the front surface 78 of the dishwasher 10 is flush with a front wall portion 110 of the kitchen unit 106.

The operation of the dishwasher 10, thus arranged, will now be described.

When the operation of the dishwasher 10 is started, the dishwasher 10 performs a conventional wash cycle and rinse cycle in sequence. After the rinse cycle, the drying cycle is started. In the drying cycle, electric power is supplied to the heater 40 and the fan motor 74. The heater 40 heats the air within the chamber 14, and the fan motor 74 rotates the first fan 72 and the second fan 86 simultaneously. When the air is heated, evaporation of the waterdrops on the dishes is promoted because the relative humidity of the air in the chamber 14 becomes lower. Then the heated air absorbing the moisture in the chamber 14 is drawn into the first outlet 48 by the first fan 72. The drawn air passes through the upper duct 58, through the first fan casino 73, and through the rear duct 60 in order. While the heated air passes in the rear duct 60, the heated air contacts the heat exchanger 68, so that the heat of the heated air in the chamber 14 is transferred to the outside air in the outside air duct 82 through the heat exchanger 68. As a result, the temperature of the air inside the chamber 14 decreases and water is condensed from the heated air. The condensed water runs into the liquid container 32 from the first inlet 52. The cooled air is exhausted from the first inlet 52, also. Then the cooled air is reheated by the heater 40, so the above circulation is continued. Electric power is also supplied to the drain motor 44 to operate the drain pump 42, so that the water collected in the liquid container 32 is drained to the outside of the chamber 14 through the drain pipe 46 by the drain pump 42.

The outside air is drawn through the second inlet 76 by the second fan 86, passes over the drain pump 42 and the drain motor 44, and flows over the heat exchanger 68 in the outside air duct 82. During this time, the drain motor 44 is cooled by the outside air. In the heat exchanger 68, the outside air absorbs the heat from the inside air through the heat exchanger 68- Then the outside air is drawn into the second fan casing 88, so that the fan motor 74 is cooled by the outside air. After that, the outside air is exhausted through the outside air duct 82 through the second outlet 80.

In accordance with the above described embodiment, as shown in FIG. 1 and FIG. 2, if the dishwasher is installed into the space 105 surrounded by the kitchen units 106, etc., the heated air exhausted from the dishwasher 10 is not held in the rearward space 105 of the dishwasher 10, and the exhausted heated air is not drawn into the dishwasher 10 again.

Therefore, since outside air of sufficiently low temperature to carry out effective heat exchange is drawn into the dishwasher 10, the heated air within the chamber 14 is effectively cooled by the outside air. As a result, the dishwasher 10 can efficiently dehumidify the air within the chamber 14, and can dry the dishes or the like in the chamber 14 efficiently.

Even if, when the dishwasher 10 is used individually, that is, when the dishwasher 10 is not installed into a space such as the space 105, there is no need to provide space rearward of the dishwasher 10 for drawing and exhausting outside air.

Also, there is no need for the dishwasher 10 to be located away from the wall, so that the space where the dishwasher 10 is provided can be minimized.

Further, since the drain motor 44 driving the drain pump 42 and the motor driving the washing pump 36 are located in the outside air duct 82, the drain motor 42 and the motor driving the washing pump 36 are efficiently cooled by the outside air drawn through the second inlet 76 of the front surface 78

The outside air drawn by the second fan 86 is heated in the portion of the heat exchanger 68 by the heat exchange, so that the weight of the air becomes light, and the air rises upwardly in the outside air duct 82. Therefore, since the natural flow direction of the outside air heated by the heat exchanger 68 is the same as the flow direction of the outside air circulated by the second fan 86, the outside air flows smoothly.

The heated air within the chamber 14 drawn through the first outlet 48 by the first fan 72 is cooled by the heat exchanger 68, and the weight of the air becomes heavy, so that the cooled air flows downwardly. As a result, since the natural flow direction of the cooled inside air is the same as the flow direction of the inside air circulated by the first fan 72, the inside air is circulated smoothly, also.

Therefore, the fan motor 74 does not need excess power for drawing the outside air and for circulating the inside air. The first fan assembly 70 has the same motor 74 as the second fan assembly 84, so that an additional motor for the second fan assembly 84 is not necessary.

Although the dishwasher 10 has been disclosed as including the single motor 74 to drive fans 72 and 86, the fans can be effectively operated with two motors respectively dedicated to drive fans 72 and 86.

Alternatively, the invention can be adopted for use in a dish dryer instead of the dishwasher.

The foregoing disclosure and drawings are merely illustrative of the principles of the present invention and not to be interpreted in a limiting sense. The only limitation is to be determined from the scope of the appended claims.

What is claimed is:

1. A utensil dryer having a front surface, comprising:

a) a chamber, having a first inlet and a first outlet, for containing utensils;

b) first passage means, provided outside of the chamber, for connecting the first inlet and the first outlet;

c) heating means, mounted in the chamber, for heating air in the chamber to promote drying of the utensils;

d) first fan means for exhausting the heated air from the chamber through the first outlet and for returning the exhausted air to the first inlet through the first passage means;

e) a second inlet provided on the front surface and a second outlet provided on the front surface;

f) second passage means, provided outside of the chamber, for connecting the second inlet and the second outlet;

g) second fan means for sucking outside air through the second inlet and for exhausting the outside air to the second outlet through the second passage means;

h) heat transferring means, provided between the first passage means and the second passage means, for transferring heat between the heated air from the chamber and the outside air in the second passage means.

2. A utensil dryer according to claim 1, wherein the second inlet and second outlet are respectively located near opposite edges of the front surface.

3. A utensil dryer according to claim 1, wherein the first and a second fan means include a first fan, a second fan and a motor coupled to drive the first and second fans.

4. A utensil dryer having a front surface, comprising:

a) a chamber having a first inlet and a first outlet, for containing utensils;

b) first passage means, provided outside of the chamber, for connecting the first inlet and the first outlet;

c) heating means, mounted in the chamber, for heating air in the chamber to promote drying of the utensils;

d) a second inlet provided on the front surface and a second outlet provided on the front surface;

e) second passage means, provided outside of the chamber, for connecting the second inlet and the second outlet;

f) fan means for circulating the heated air from the chamber through the first outlet, the first passage means and back to the chamber through the first inlet, and for circulating outside air through the second inlet, the second passage means and through the second outlet; and g) heat transferring means, provided between the first passage means and the second passage means, for transferring the heat between the heated air in the first passage means and the outside air in the second passage means.

5. A utensil dryer having a front surface, comprising:

a) a chamber having an upper wall, a rear wall, and a bottom, a first inlet located on the upper wall, a first inlet located on a lower portion of the rear wall, for containing utensils;

b) a container, located on the bottom, for containing water;

c) first passage means, provided outside of the chamber, for connecting the first inlet and the first outlet;

d) heating means, mounted in the chamber, for heating air in the chamber to promote drying of the utensils;

e) first fan means, including a first fan and a fan motor, for circulating the heated air from the first outlet to the first inlet through the first passage means;

f) a second inlet provided on a lower portion of the front surface;

g) a second outlet provided on an upper portion of the front surface;

h) second passage means, provided around the chamber, for connecting the second inlet and the second outlet;

i) a drain pump including a drain motor, located in the second passage means, for draining the water from the container;

j) second fan means, including a second fan driven by the fan motor, for sucking outside air through the second inlet and for exhausting the outside air to the second outlet through the second passage means; and k) heat transferring means, provided between the first passage means and the second passage means, for transferring the heat between the heated air in the first passage means and outside air in the second passage means.

6. A system including a series of kitchen units having a front wall portion, comprising:

a utensil dryer having a front surface, comprising:

a) a chamber, having a first inlet and a first outlet, for containing utensils;

b) first passage means, provided outside of the chamber, for connecting the first inlet and the first outlet;

c) heating means, mounted in the chamber, for heating air in the chamber to promote drying of the utensils;

d) first fan means for exhausting the heated air from the chamber through the first outlet and for returning the exhausted air to the first inlet through the first passage means;

e) a second inlet and a second outlet, each provided on the front surface;

f) second passage means, provided outside of the chamber, for connecting the second inlet and the second outlet;

g) second fan means for sucking outside air through the second inlet and for exhausting the outside air to the second outlet through the second passage means; and h) heat transferring means, provided between the first passage means and the second passage means, for transferring heat between the heated air in the chamber and the outside air in the second passage means, said utensil dryer mounted in a space defined on one side by at least one of the kitchen units and on an opposite side by one of a wall and another one of the kitchen units.

7. A system according to claim 6, wherein the front surface of the utensil dryer is flush with the front wall portion.

8. In a utensil dryer having a front surface and a chamber for containing the utensils to be dried, a method for drying the utensils, comprising the steps of:

heating air within the chamber, drawing the heated air from an upper portion of the chamber, passing the drawn heated air over a first side of a heat exchanger to provide cooled air, exhausting the cooled air into a lower portion of the chamber, drawing air from outside the utensil dryer through an inlet in a lower portion of the front surface, passing the drawn outside air over a second side of the heat exchanger to cool the heated air passed over the heat exchanger first side, and exhausting the outside air, after passing over the heat exchanger second side, through an outlet in an upper part of the front surface of the dryer.

9. A utensil dryer having a front surface, comprising:

a) a chamber, having a first inlet and a first outlet, for containing utensils;

b) first passage means, provided outside of the chamber, for connecting the first inlet and the first outlet;

c) heating means, mounted in the chamber, for heating air in the chamber to promote drying of the utensils;

d) first fan means for exhausting the heated air from the chamber through the first outlet and for returning the exhausted air to the first inlet through the first passage means;

e) a second inlet located on the front surface near a lower edge thereof and a second outlet located on an opposite upper edge of the front surface;

f) second passage means, provided outside of the chamber, for connecting the second inlet and the second outlet;

g) second fan means for sucking outside air through the second inlet and for exhausting the outside air to the second outlet through the second passage means; and h) heat transferring means, provided between the first passage means and the second passage means, for transferring heat between the heated air from the chamber and the outside air in the second passage means.

10. A utensil dryer having a front surface, comprising:

a) a chamber, having a first inlet and a first outlet, for containing utensils;

b) first passage means, provided outside of the chamber, for connecting the first inlet and the first outlet;

c) heating means, mounted in the chamber, for heating air in the chamber to promote drying of the utensils;

d) first fan means, comprising a first fan, for exhausting the heated air from the chamber through the first outlet and for returning the exhausted air to the first inlet through the first passage means;

e) a second inlet provided on the front surface and a second outlet provided on the front surface;

f) second passage means, provided outside of the chamber, for connecting the second inlet and the second outlet;

g) second fan means, comprising a second fan, for sucking outside air through the second inlet and for exhausting the outside air to the second outlet through the second passage means;

h) heat transferring means, provided between the first passage means and the second passage means, for transferring heat between the heated air from the chamber and the outside air in the second passage means; and i) a motor located in the second passage means coupled to said first and second fan, the motor being cooled by the outside air from the second inlet.

11. A utensil dryer having a front surface, comprising:

a) a chamber, having a first inlet and a first outlet, for containing utensils;

b) first passage means, provided outside of the chamber, for connecting the first inlet and the first outlet;

c) heating means, mounted in the chamber, for heating air in the chamber to promote drying of the utensils;

d) first fan means for exhausting the heated air from the chamber through the first outlet and for returning the exhausted air to the first inlet through the first passage means;

e) a second inlet and a second outlet provided on the front surface;

f) second passage means, provided outside of the chamber, for connecting the second inlet and the second outlet;

g) second fan means for sucking outside air through the second inlet and for exhausting the outside air to the second outlet through the second passage means;

h) heat transferring means, provided between the first passage means and the second passage means, for transferring heat between the heated air from the chamber and the outside air in the second passage means; and i) a drain pump having a drain motor located under the chamber and in the second passage means so that the drain motor is cooled by the outside air from the second inlet.

* * * * *